US007509072B2

(12) United States Patent
Nagahama

(10) Patent No.: US 7,509,072 B2
(45) Date of Patent: Mar. 24, 2009

(54) IMAGE FORMING APPARATUS

(75) Inventor: Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 131 days.

(21) Appl. No.: 11/157,152

(22) Filed: Jun. 21, 2005

(65) Prior Publication Data

US 2005/0286914 A1 Dec. 29, 2005

(30) Foreign Application Priority Data

Jun. 28, 2004 (JP) ..... 2004-189633

(51) Int. Cl.
*G03G 15/00* (2006.01)
*G03G 15/08* (2006.01)
*G03G 21/18* (2006.01)

(52) U.S. Cl. ..... 399/114; 399/12; 399/27; 399/120

(58) Field of Classification Search ..... 399/114, 399/8, 12, 27, 119, 120
See application file for complete search history.

(56) References Cited

U.S. PATENT DOCUMENTS 4,062,061 A * 12/1977 Batchelor et al. ..... 714/47
5,053,816 A * 10/1991 Takahashi ..... 399/12
6,324,351 B1 * 11/2001 Kurimoto et al. ..... 399/12
6,404,995 B1 * 6/2002 Kimizuka ..... 399/13
6,560,423 B2 * 5/2003 Matsubara ..... 399/107
2003/0108355 A1 * 6/2003 Watanabe et al. ..... 399/12
2003/0180059 A1 9/2003 Iida et al.
2005/0191064 A1 * 9/2005 Park et al. ..... 399/12

FOREIGN PATENT DOCUMENTS

JP 10-221938 A 8/1998
JP 11-348375 A 12/1999
JP 2000-338778 12/2000
JP 2001-022230 A 1/2001
JP 2001-117309 A 4/2001
JP 2001-290400 A 10/2001
JP 2002-49206 A 2/2002
JP 2002-156890 A 5/2002
JP 2002-171372 A 6/2002
JP 2003-208076 A 7/2003
JP 2003-271042 9/2003

* cited by examiner

*Primary Examiner*—David M Gray
*Assistant Examiner*—Joseph S. Wong
(74) *Attorney, Agent, or Firm*—Nixon & Vanderhye P.C.

(57) ABSTRACT

The present invention provides the image forming apparatus for successively performing information communication between an attaching part and the main body of the image forming apparatus. The communication-end antenna section 11 is provided in the toner supplying holder-containing section 3 in the main body of the image forming apparatus, so as to face the IC tag in the toner supplying holder 2. The toner supplying holder-containing section 3 is covered with the electromagnetic shield material 7.

7 Claims, 7 Drawing Sheets

IMAGE FORMING APPARATUS

This non-provisional application claims priority under 35 U.S.C. § 119(a) on Patent Application No. 2004/189633 filed in Japan on Jun. 28, 2004, the entire contents of which are hereby incorporated by reference.

FIELD OF THE INVENTION

The present invention relates to an image forming apparatus which performs wireless information communication with an attaching part that is detachable to the image forming apparatus.

BACKGROUND OF THE INVENTION

An image forming apparatus using an electronic photograph method such as a copying machine or a printer needs miscellaneous maintenances. Examples of the maintenances are supplement of expendable supplies such as developer, and exchange of a variety of parts that are detachable to the image forming apparatus according to their durability. In the maintenance, the part attached to the image forming apparatus (called an attaching part hereinafter) often contains a storage element which stores registration of a variety of information about the attaching part. In this arrangement, communication is established between the main body of the image forming apparatus and the attaching part via wireless communication or the like, and the image forming apparatus detects the information registered in the storage element. In this way, the image forming apparatus detects the timing for supplement of expendable supplies or the timing for exchanging attaching parts, and also prevents false attachment of the detachable parts (for example, see Documents 1 through 5).

For example, document 1 describes a process cartridge attached to an image forming apparatus, which process cartridge is provided with a storage element in which an IC and a communication antenna are integrally constructed. The process cartridge designates a unit in which at least one of charging means, development means and cleaning means is combined with an electrophotography photo conductor drum inside a cartridge which is detachable to the main body of the image forming apparatus. The storage element contained in the process cartridge is positioned so that it becomes opposite to a communication antenna (called a main body antenna hereinafter) contained in the main body of the image forming apparatus when the above process cartridge is attached to the image forming apparatus. With this configuration, when power is supplied to the storage element, non-contact communication is established between the storage element and the main body antenna.

The above storage element is vulnerable to electromagnetism, mechanic vibration and heat caused by a motor that is a driving source of a conveyor belt used in a production step of a process cartridge, which may cause unwanted change of contents of the information stored in the storage element. In this view, in the document 1, the storage element is mounted to a process cartridge in the final step of fabrication of the process cartridge so as to prevent such defects of the storage element.

The process cartridge described in the document 1, which achieves prevention of the bad influence on the storage element by electromagnetism, vibration and heat in production steps or assembly steps of the process cartridge, however still has a problem of communication noise caused by a variety of electromagnetic waves generated in the environment under which the image forming apparatus is used.

More specifically, general communication between a storage element and a main body antenna uses an electromagnetic wave whose communication frequency falls in a range of AM wavelength (MF (Middle Frequency)). This wave (called AM wave hereinafter) is likely to be influenced by an electromagnetic wave generated by a variety of electric appliances such as TVs, videos, stereos, computers, refrigerators, air conditioners, dryers, and portable phones. As a result, in a room where the image forming apparatus is installed, the above electric appliance becomes the noise source that prevents good reception of AM wave. Such a defect often results in hindrance to communication wave between the storage element and the main body antenna, or interference in electromagnetic induction in the main body antenna, thereby blocking power supply. Therefore, communication error easily occurs between the storage element and the main body antenna.

Further, in the main body of the image forming apparatus, there are miscellaneous noise sources such as a magnetic field generated around motors and a harness, and an electromagnetic wave coming from high-voltage-generating circuits. Particularly, when an electrostatic noise is generated in the image forming apparatus, there is a possibility that the above storage element is destroyed.

Further, when the process cartridge is exchanged according to durability or for supplement of expendable supplies as described above, a spare cartridge for exchange or a used cartridge may be placed near the image forming apparatus. The storage element of this process cartridge, that is not attached to the image forming apparatus but is placed near the image forming apparatus, may also be a cause of hindrance to stable communication between the storage element of the process cartridge in the image forming apparatus and the main body antenna.

As described above, in the environment under which the image forming apparatus is installed, there are various factors generating electromagnetic waves which cause communication noises. Therefore, for a conventional process cartridge, there has been a difficulty in accurately performing information communication between a storage element and a main body antenna.

[Document 1] Japanese Laid-Open Patent Publication 156890/2002 (Tokukai 2002-156890) (published date; May 31, 2002)

[Document 2] Japanese Laid-Open Patent Publication 49206/2002 (Tokukai 2002-49206) (published date; Feb. 15, 2002)

[Document 3] Japanese Laid-Open Patent Publication 117309/2001 (Tokukai 2001-117309) (published date; Apr. 27, 2001)

[Document 4] Japanese Laid-Open Patent Publication 22230/2001 (Tokukai 2001-22230) (published date; Jan. 26, 2001)

[Document 5] Japanese Laid-Open Patent Publication 221938/1998) (Tokukaihei 10-221938) (published date; Aug. 21, 1998)

SUMMARY OF THE INVENTION

The present invention is made in view of the foregoing problem, and an object is to provide an image forming apparatus for securely performing information communication between its main body and an attaching part.

In order to solve the above problem, the image forming apparatus according to the present invention has an attaching part detachable to its main body, the attaching part including a communication device for carrying out non-contact information communication with a communication section of a communication unit included in the main body of the image forming apparatus, and includes an electromagnetic shield material which covers at least the communication device and the communication section, when the attaching part is attached to the main body of the image forming apparatus.

According to this structure, the image forming apparatus includes the electromagnetic shield material which covers the communication device and the communication section so as to isolate the communication device contained in the attaching part and the communication section of the communication unit from external electromagnetic wave and a magnetic field. Therefore, when wireless information communication is performed between the attaching part that is detachable to the main body of the image forming apparatus and the communication unit included in the main body of the image forming apparatus, the electromagnetic shield material can block the external electromagnetic wave and the magnetic field, thereby preventing defects from the noises in transmission and reception of information between the communication device and the communication section. In this way, the image forming apparatus is immune to communication error by noise.

Therefore, it is possible to provide the image forming apparatus capable of performing stable information communication with the attaching part attached thereto.

For a fuller understanding of the nature and advantages of the invention, reference should be made to the ensuing detailed description taken in conjunction with the accompanying drawings.

DESCRIPTION OF THE EMBODIMENTS

An embodiment of the present invention is explained below with reference to FIGS. 1 through 7.

Figure 1:
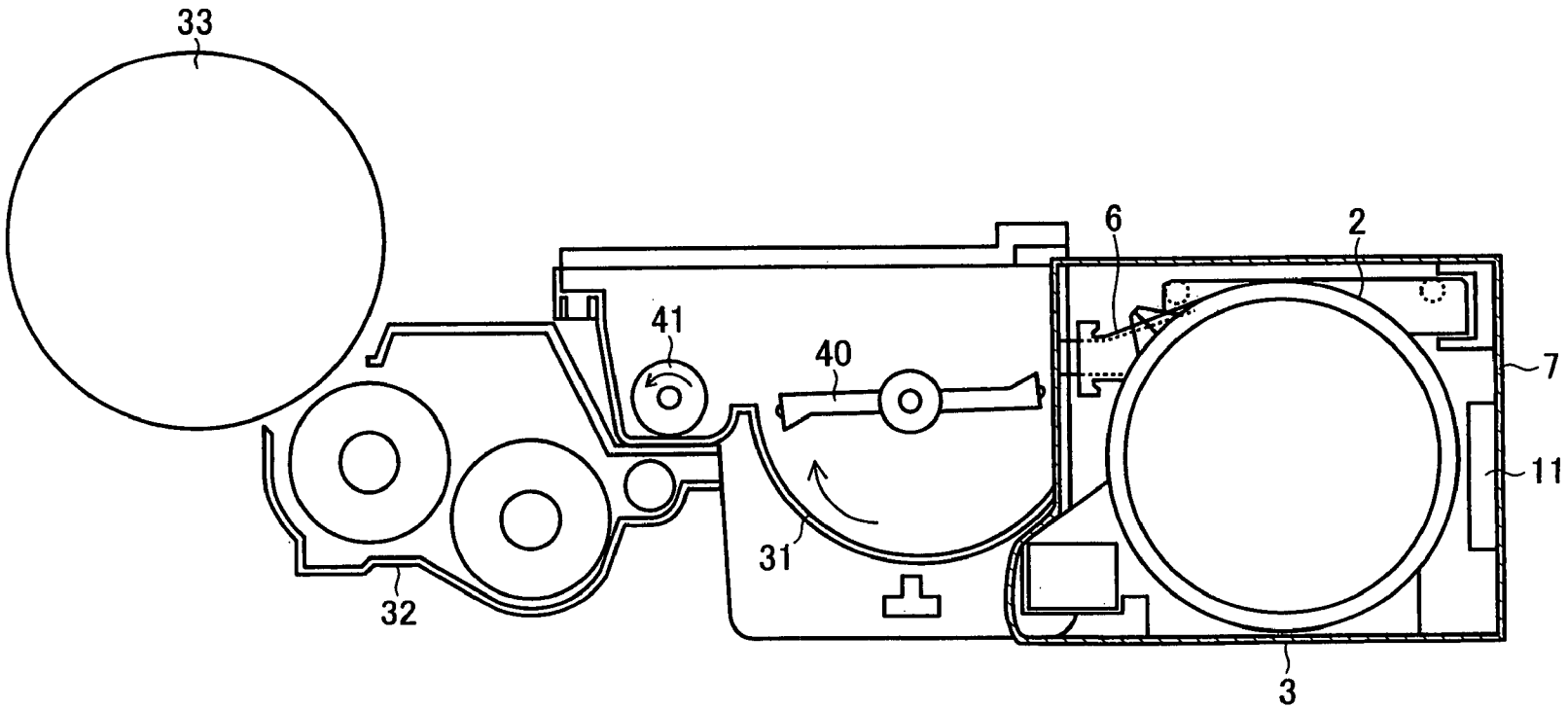
FIG. 1 is a front view of a main part of an image forming apparatus according to one embodiment of the present invention.
Figure 2:
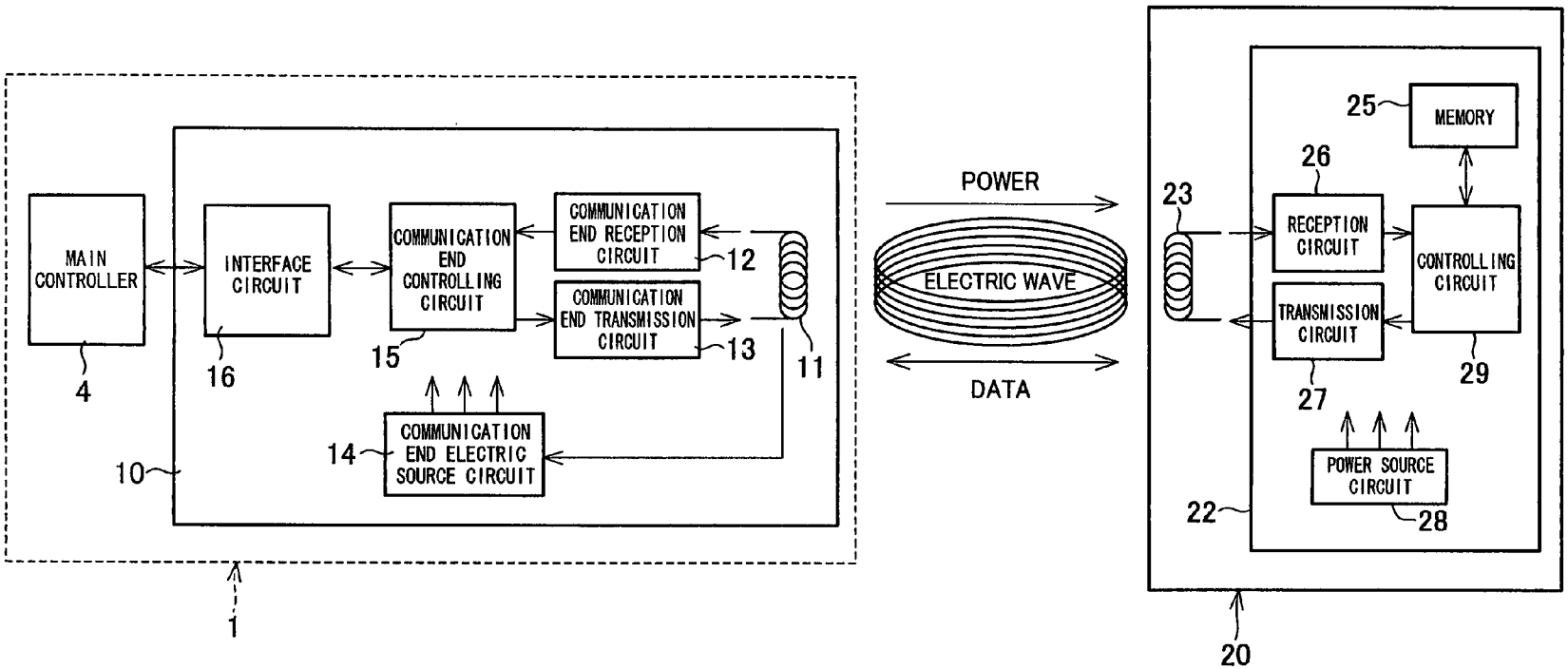
FIG. 2 is a block diagram for explaining communication between a communication unit provided in the image forming apparatus and an IC tag mounted to a toner supplying holder.

FIG. 1 is a front view of a main part of an image forming apparatus 1 of the present embodiment such as a printer, the view showing the vicinity of a portion where a toner supplying holder 2 is attached. FIG. 2 is a block diagram explaining communication between a main body of the image forming apparatus 1 and the toner supplying holder 2.

As shown in FIG. 1, the image forming apparatus 1 includes the toner supplying holder (an attaching part) 2 having a toner therein and a toner supplying holder-containing section 3 for containing the toner supplying holder 2. As shown in FIG. 2, the image forming apparatus 1 further includes a main controller 4 such as CPU and a communication unit 10 in the main body of the image forming apparatus 1, and an IC tag (an communication device) 20 in the toner supplying holder 2.

The toner supplying holder-containing section 3 is provided for attaching the toner supplying holder 2 to the image forming apparatus 1. As shown in FIG. 1, the toner supplying holder-containing section 3 contains the toner supplying holder 2 by covering the entire body of the toner supplying holder 2, and fixes the toner supplying holder 2 in the image forming apparatus 1.

As shown in FIG. 1, the toner supplying holder-containing section 3 includes a communication-end antenna section (a communication section; called a communication-end antenna section hereinafter) 11 of the communication unit 10 provided in the main body of the image forming apparatus 1. Inside the toner supplying holder-containing section 3, the communication-end antenna section 11 is disposed oppositely to the toner supplying holder 2 but is not in contact with the toner supplying holder 2. The communication-end antenna section 11 performs transmission and reception of information by reading/writing, in a wireless method, information from/to the later mentioned IC tag 20 provided in the toner supplying holder 2.

As shown in FIG. 2, the communication-end antenna section 11 is contained in the communication unit 10 provided in the image forming apparatus 1. In addition to the communication-end antenna section 11, the communication unit 10 includes a communication-end reception circuit 12, a communication-end transmission circuit 13, a communication-end power source circuit 14, a communication-end controlling circuit 15 and an interface circuit 16.

The communication-end antenna section 11 is used for both transmission and reception. The communication-end antenna section 11 is made of a resin plate with a metallic thin film winded around it several times, forming a loop wiring. It is preferable that the communication-end antenna section 11 has a size large enough to cover the entire region opposite to the later mentioned IC tag 20, the entire region being a part of the toner supplying holder-containing section 3.

Further, the communication-end reception circuit 12 carries out conversion of a reception signal received by the communication-end antenna section 11, and sends the converted signal to the communication-end controlling circuit 15. The communication-end transmission circuit 13 carries out conversion of a signal outputted from the communication-end controlling circuit 15, and sends the converted signal to the communication-end antenna section 11. The communication-end power source circuit 14 supplies power to the communication-end reception circuit 12, the communication-end transmission circuit 13, the communication-end controlling circuit 15, and the interface circuit 16. Further, the interface circuit 16 controls input/output of data between the main controller 4 of the image forming apparatus 1 and the communication unit 10. The communication-end controlling circuit 15 controls the whole operation of the communication unit 10.

Therefore, when the communication-end antenna section 11 provided in the toner supplying holder-containing section 3 receives information from the IC tag 20 provided in the toner supplying holder 2, the information is outputted from the communication-end controlling circuit 15 to the main controller 4 of the image forming apparatus 1 through the interface circuit 16, thereby enabling the main controller 4 to control the performance of the image forming apparatus 1, based on the information from the IC tag 20. This mechanism is more specifically described later.

Figure 3:
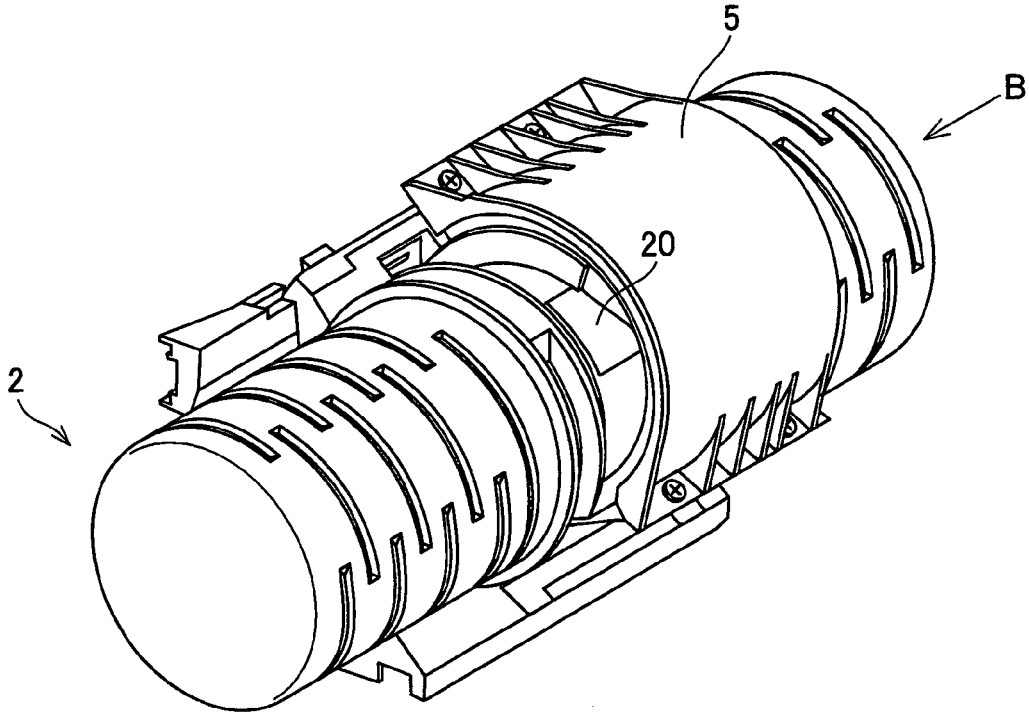
FIG. 3 is a perspective view of the toner supplying holder attached to the image forming apparatus.

FIG. 3 is a perspective view of the toner supplying holder 2 attached to the image forming apparatus 1. The toner supplying holder 2 is detachable to the toner supplying holder-containing section 3 (FIG. 1) in the main body of the image forming apparatus 1. Further, as shown in FIG. 3, the toner supplying holder 2 has a round body, and is rotatably supported by a supporting part 5. With this structure, the toner supplying holder 2 rotates while being supported by the supporting part 5, thereby supplying toner from a toner outlet 6 to a later mentioned toner hopper 31, as shown in FIG. 1.

Further, as shown in FIG. 3, the IC tag 20 for communicating with the communication-end antenna section 11 in a non-contact manner is mounted to the toner supplying holder 2. For example, the IC tag 20 is mounted to the toner supplying holder 2 by adhesive or by being ploughed therein. The position of the IC tag 20 can be determined only in terms of capability of communication with the communication-end antenna section 11 by use of electric wave. For example, the IC tag 20 may be placed on the supporting part 5, on an outer surface of the toner supplying holder 2, whose surface becomes opposite to the communication-end antenna section 11 by the rotation of the toner supplying holder 2, or on a portion inside the toner supplying holder 2 where the communication with the communication-end antenna section 11 is possible.

Figure 4:
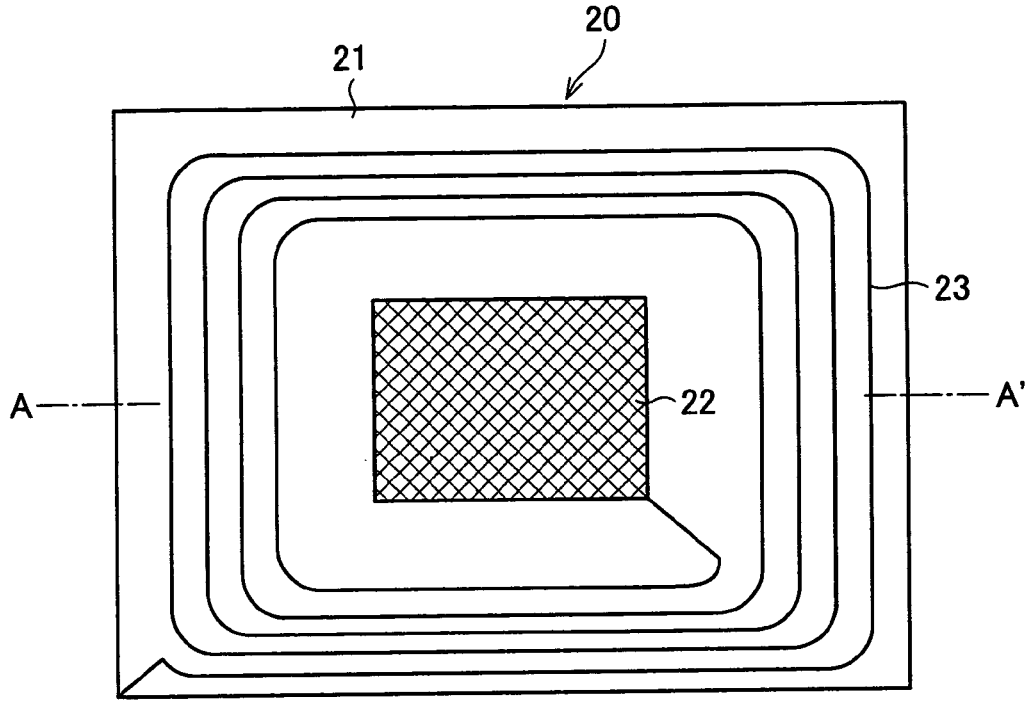
FIG. 4(*a*) is a plane view showing the IC tag, and FIG. 4(*b*) is a cross sectional view taken along the line A-A', showing the IC tag.
Figure 4:
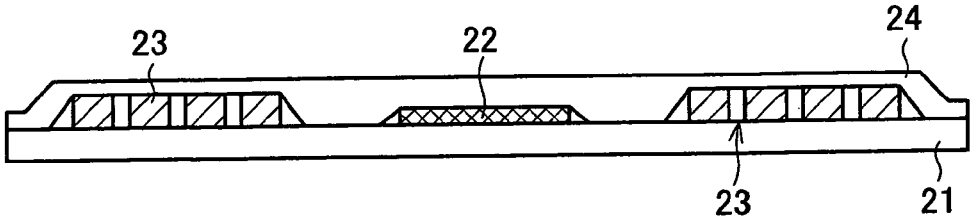

FIGS. 4(*a*) and 4(*b*) are a lateral view and a cross section view of the IC tag 20. As shown in FIGS. 4(*a*) and 4(*b*), in the IC tag 20, an IC chip 22 is mounted on a substrate 21, which is made of a resin or the like; further, a metallic thin film or the like is winded around the IC chip 22 several times, forming a loop wiring serving as an antenna section 23. As for the antenna section 23, both transmission and reception may be carried out by a single antenna section, or transmission and reception may be separately carried out by respective antenna sections 23. The IC chip 22 and the antenna section 23 are connected electrically, and the IC chip 22 and the antenna section 23 are covered with a protective film 24.

As shown in FIG. 2, the IC chip 22 includes a memory (a storage section) 25, a reception circuit 26, a transmission circuit 27, a power source circuit 28 and a controlling circuit 29.

The memory 25, which is, for example, a nonvolatile memory, contains a variety of management information about the toner supplying holder 2. The management information is various information items helpful in use of the toner supplying holder 2 or toner contained inside the toner supplying holder 2, for example, a lot number, such as company code or machine-type code, date manufactured, the kind of toner, the content, retention period, and distinction between a used product or a new product. Making it possible to rewrite information of the memory 25 allows renewal of the management information, thereby allowing the memory 25 to be used repeatedly when the toner supplying holder 2 is recycled.

The reception circuit 26 carries out conversion of a reception signal received by the antenna section 23 and sends the converted signal to the controlling circuit 29. The transmission circuit 27 carries out a conversion of a signal outputted from the controlling circuit 29 and sends the converted signal to the antenna section 23. The power source circuit 28 rectifies an electric wave for communication and supplies power. The controlling circuit 29 controls the whole operation of the IC tag.

Further, as shown in FIG. 1, the image forming apparatus 1 includes an electromagnetic shield material 7 in the main body of the image forming apparatus 1, so that information communication between the communication-end antenna section 11 and the IC tag 20 is not disturbed when the toner supplying holder 2 is attached to the toner supplying holder-containing section 3. The electromagnetic shield material 7 is disposed, for example, as shown in FIG. 1, inside the toner supplying holder-containing section 3, combined with the toner supplying holder-containing section 3. Further, the electromagnetic shield material 7 is preferably provided in an openable and closable door provided in the main body of the image forming apparatus 1, the door being positioned in view of allowing the toner supplying holder 2 to be inserted into and attached to the toner supplying holder-containing section 3. To put it more concretely, it is preferable to dispose the electromagnetic shield material 7 in an area opposite to the toner supplying holder 2 in the openable and closable door. With this structure, the toner supplying holder 2 is wholly covered with the electromagnetic shield material 7 while being attached to the toner supplying holder-containing section 3.

As shown above, when the electromagnetic shield material 7 is disposed inside the toner supplying holder-containing section 3, there is a possibility that communication between the communication-end antenna section 11 provided inside the toner supplying holder-containing section 3 and the IC tag 20 provided in the toner supplying holder 2 is blocked by the electromagnetic shield material 7. Therefore, the communication-end antenna section 11 is provided on the electromagnetic shield material 7. With this arrangement, an electromagnetic wave from outside of the toner supplying holder-containing section 3 is blocked, thereby allowing stable communication between the communication-end antenna section 11 provided in the toner supplying holder-containing section 3 and the IC tag 20 in the toner supplying holder 2.

The electromagnetic shield material 7 may be any kind as long as it is capable of blocking electromagnetic wave. Suitable examples of the material include an electroless-metal-plated shield material, a conductive plastic shield material, an electromagnetic wave shield cloth, a nickel fiber sheet, an absorbing type electromagnetic shield material, an electromagnetic wave shield rubber, and an electromagnetic wave shield glass. These materials may be used alone or as a combination.

The electroless-metal-plated shield material is made by plating a surface of plastic or other kind of substrate with a metal, such as copper or nickel, through electroless metal plating. Further, the conductive plastic shield material is made by mixing a resin (e.g. plastic) with a conductive filler such as (a) carbon; (b) metal fiber made by chatter vibration cutting method such as brass, aluminum or copper; or (c) stainless fiber.

The electromagnetic shield cloth is a glass fiber cloth (textile glass) using a coated yarn made of a glass fiber coated with nickel, or a metallized fiber cloth made of a base material of polyester or the like plated with a metal such as copper or nickel through electroless plating.

The nickel fiber sheet is obtained by plating with nickel a pitch-based carbon fiber as a base material, and then successively carrying out a process for removing a carbon fiber through heat-treating. The process in such a method brings a nickel fiber cloth with homogeneity and high purity.

The absorbing type electromagnetic shield material is a shield material using an alloy, such as iron silicon alloy, as an electromagnetic wave absorber.

The electromagnetic shield rubber is made of a synthetic rubber base, which is mixed with zinc, conductive carbon black, sulfur, or a carbon fiber, and, as required, further mixed with softener (e.g. stearic acid); processing aid; vulcanization accelerator; or age resister.

The electromagnetic wave shield glass is made by superposing a metal coating glass, that is a glass coated with a metallic layer of tungsten, copper etc., on a mesh glass having minute mesh patterns on its surface.

Note that, in the above example, the electromagnetic shield material 7 is provided by covering the inner surface of the toner supplying holder-containing section 3, but the present invention is not limited to this. The electromagnetic shield material may be provided by covering the outer surface of the toner supplying holder-containing section 3.

Further, instead of providing the electromagnetic shield material on the outer surface or the inner surface of the toner supplying holder-containing section 3 as shown above, it is possible to form the toner supplying holder-containing section 3 with an electromagnetic shield material.

Similarly, in the above example, the electromagnetic shield material screens the entire body of the toner supplying holder-containing section 3 when the toner supplying holder 2 is attached to the image forming apparatus 1; however, the electromagnetic shield material may cover at least the communication-end antenna section 11 and the antenna section 23 from the external electromagnetic wave.

When the toner supplying holder 2 is attached to the image forming apparatus 1 with the above structure, the communication-end antenna section 11 in the toner supplying holder-containing section 3 becomes opposite to the IC tag 20 in the toner supplying holder 2, but they are not in contact with each other. In this state, information communication between the communication unit 10 and the IC tag 20 becomes possible through the communication-end antenna section 11.

More specifically, a signal supplied by the main controller 4 to the communication-end controlling circuit 15 through the interface circuit 16 of the communication unit 10 is then converted into a transmission signal by the communication-end transmission circuit 13. This signal is transmitted as an electric wave by the communication-end antenna section 11, and is received by the antenna section 23 of the IC tag 20. Thereafter, the power source circuit 28 of the IC tag 20 rectifies the electric wave, and supplies power to the reception circuit 26, the controlling circuit 29, the transmission circuit 27 etc. in the IC tag 20.

Further, the reception circuit 26 converts the signal received by the antenna section 23 into a different form so that the signal can be processed in the IC tag 20, and transmits the converted signal to the controlling circuit 29. The controlling circuit 29 reads out predetermined management information from the memory 25 on the basis of the signal received by the reception circuit 26, and converts the information into a transmission signal in the transmission circuit 27, and then outputs the signal to the antenna section 23.

The signal outputted from the transmission circuit 27 through the antenna section 23 is received by the communication antenna section 11 of the communication unit 10, and then converted by the communication-end reception circuit 12 into a signal that is able to be processed in the image forming apparatus 1. The converted signal is transmitted to the communication-end controlling circuit 15 and then outputted to the main controller 4 through the interface circuit 16, thereby enabling the main controller 4 to control operations of each section of the image forming apparatus 1.

More specifically, based on the management information which includes various information items about the toner supplying holder 2, a judgment is carried out as to the content of toner in the toner supplying holder 2, compatibility of the toner supplying holder 2 with the main body of the image forming apparatus 1, the timing for exchange of the toner supplying holder 2 etc., and if necessary, a warning message or the like to the user is displayed on a display section (not shown) or the like of the image forming apparatus 1.

Alternatively, this operation may be carried out in such a manner that the type of toner in the toner supplying holder 2 is read out from the management information, and the main controller 4 determines operation condition of each section of the image forming apparatus 1 according to the optimal values of charging voltage, light exposure and fixing temperature etc. with respect to the toner in the image forming.

Figure 5:
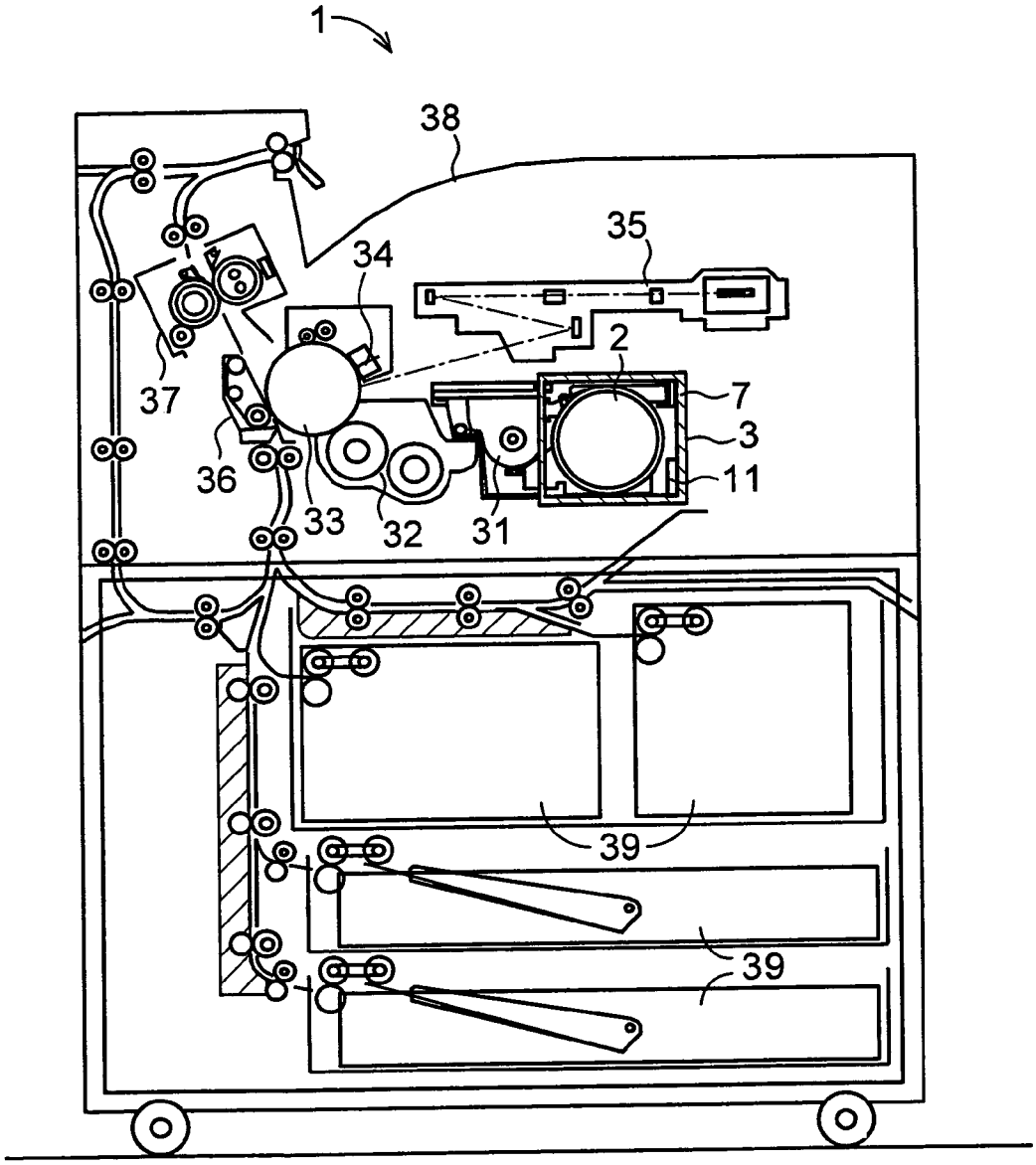
FIG. 5 is a front view of the image forming apparatus.

Next, image forming operation of the image forming apparatus 1 is explained. FIG. 5 shows a front view of the image forming apparatus 1. In order to perform the image forming operation, as shown in FIG. 1 and FIG. 5, the image forming apparatus 1 includes, in addition to the toner supplying holder 2 contained in the toner supplying holder-containing section 3, a toner hopper 31, a development unit 32, a photo conductor drum 33, an electrification unit 34, a laser exposure unit 35, a transcriber 36, a fixing section 37, a paper ejecting section 38 and a paper feeding section 39.

When the image formation is performed in the image forming apparatus 1 with the above structure, first, the electrification unit 34 shown in FIG. 5 charges a surface of the photo conductor drum 33 serving as an electrostatic latent image supporter. After that, the laser exposure unit 35 forms an electrostatic latent image on the surface of the photo conductor drum 33. Next, as shown in FIG. 1, toner having been supplied from the toner supplying holder 2 through the toner hopper 31 is stirred by an agitator 40, and then is sent to the development unit 32 by rotation of a toner supplying roller 41. Then, the development unit 32 disposed oppositely to the surface of the photo conductor drum 33 forms a toner image by developing the electrostatic latent image on the photo conductor drum 33 into a visible image. The toner image formed on the photo conductor drum 33 is transcribed by the transcriber 36 onto a recording paper conveyed from the paper feeding section 39. The toner image transcribed on the recording paper is then fixed by the fixing section 37, before the recording paper is ejected to the paper ejecting section 38.

Figure 6:
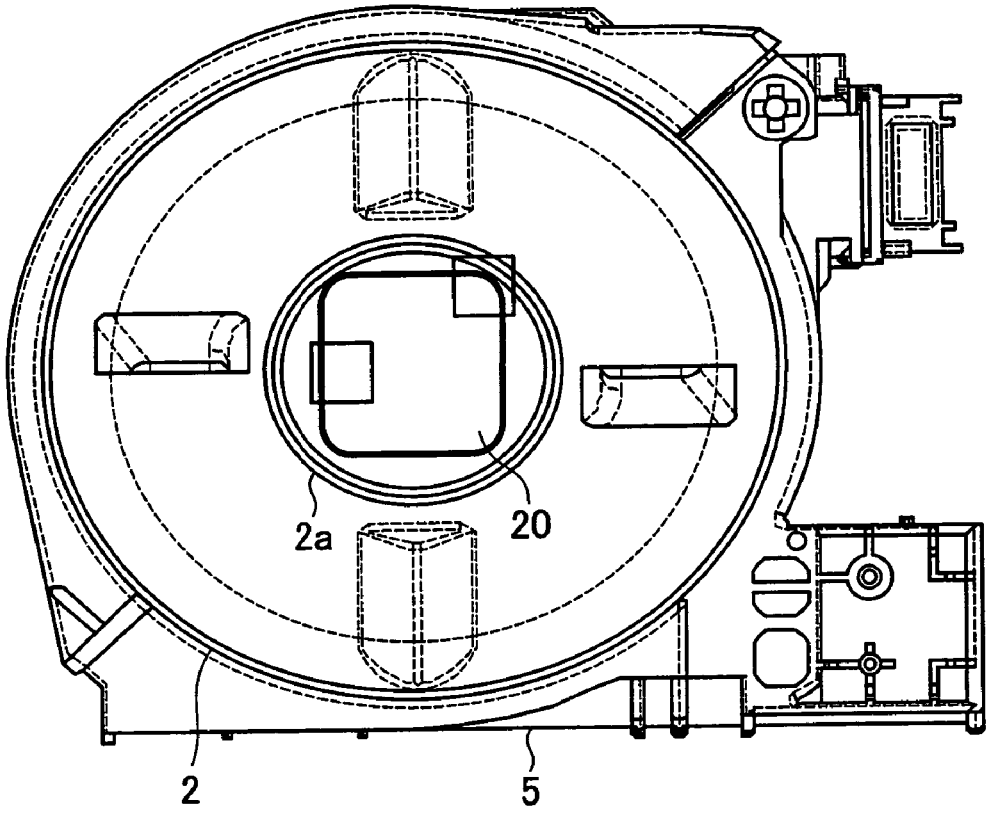
FIG. 6 is a front view showing a toner-charging orifice of the toner supplying holder.

Note that in the present embodiment, the communication-end antenna section 11 is provided in the toner supplying holder-containing section 3, but the disposition of the communication-end antenna section 11 is not limited to this. The position of the communication-end antenna section 11 may be determined according to the disposition of the IC tag in the toner supplying holder 2. FIG. 6 shows a front view of a cap 2*a* of the toner-charging orifice provided in B side of the toner supplying holder 2, which is shown in FIG. 3. In this case, as shown in FIG. 6, the IC tag 20 is provided in the cap 2*a* of the toner supplying holder 2. Accordingly, the communication-end antenna section 11 should be provided in a predetermined position opposite to the cap 2*a* in the image forming apparatus 1 when the toner supplying holder 2 is attached to the image forming apparatus 1. More specifically, the communication-end antenna section 11 should be provided, for example, in the exterior of the image forming apparatus 1 or in the openable and closable door, that is provided in one side of the image forming apparatus 1, allowing the toner supplying holder 2 to be attached thereto.

In this case, the electromagnetic shield material is provided according to the disposition of the communication-end antenna section. Namely, the electromagnetic shield material should be disposed in terms of isolation of the external electromagnetic wave from the IC tag and the communication-end antenna section, so as to prevent interference of external electromagnetic wave to the communication between the IC tag on the toner supplying holder 2 and the communication-end antenna section of the image forming apparatus 1.

Further, in the present embodiment, the structure in which the toner supplying holder 2 is detachable to the image forming apparatus 1 is exemplified, but the present invention is not limited to this structure. For example, the present invention can be applied to any attaching part that is detachable to the image forming apparatus 1. Namely, it is possible to provide an IC tag in an attaching part such as the electrification unit 34, the development unit 32, the photo conductor drum 33, or the cleaning means (not shown) for collecting residual toner on the surface of the photo conductor drum 33, all of which are exchangeable according to their durability, as shown in FIG. 5. In this case, as with the example above, the communication-end antenna section is provided in the main body of the image forming apparatus 1 for allowing itself to communicate with the IC tag, and the electromagnetic shield material is provided by covering the IC tag and the communication-end antenna section after the attaching part is attached to the image forming apparatus 1.

Further, the present invention may be applied to other kind of cartridges, such as a development cartridge that contains the toner supplying holder 2, the toner hopper 31 etc. shown in FIG. 1 in one cartridge, thus being detachable with these sections all together; or a process cartridge that contains at least two of: the toner supplying holder 2, the toner hopper 31, the electrification unit 34 (FIG. 5), the development unit 32, the photo conductor drum 33, the cleaning means and the like in one cartridge, and such various cartridges are made in view of improvement in operativity in maintenance and exchange. In this case, it is preferable that the electromagnetic shield material is provided in the main body of the image forming apparatus 1 so as to cover the development cartridge or the process cartridge, when these development cartridge or process cartridge is attached to the main body of the image forming apparatus 1.

Figure 7:
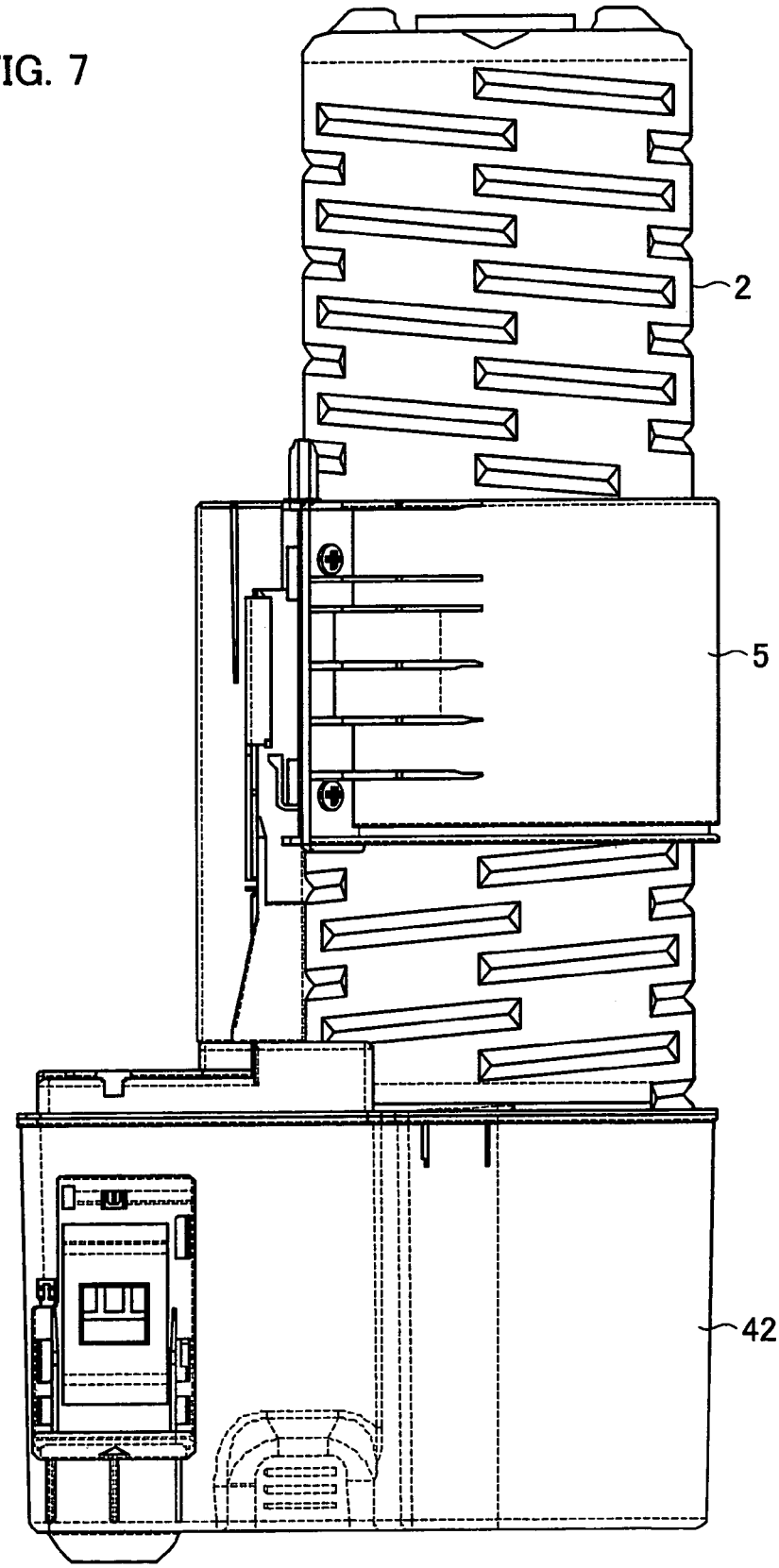
FIG. 7 is a lateral view showing a toner supplying holder provided with a toner collecting container.

Alternatively, as shown in FIG. 7, this structure may be modified such that a toner collecting container 42 for recycling waste toner is provided in the end portion of the toner supplying holder 2 by being combined with the toner supplying holder 2, and the IC tag is provided in the toner collecting container 42.

Further, in the above embodiment, the case where the communication unit 10 communicates with one IC tag 20 is exemplified, but the present invention may alternatively be arranged so that the communication unit 10 communicates with a plurality of IC tags. That is, even when a plurality of the toner supplying holders 2 are provided with respective IC tags, or when the IC tags are also provided in other attaching parts than the toner supplying holder 2; the electromagnetic shield material is required to cover at least the communication-end antenna section of the communication unit and the IC tag. When the communication unit 10 communicates with a plurality of the IC tags, communication is performed either with one communication-end antenna section, or with a plurality of communication-end antenna sections for the respective IC tags.

Therefore, the electromagnetic shield material may cover each communication-end antenna section and each IC tag individually, or cover the whole of the communication-end antenna sections and the IC tags. However, because there are miscellaneous noise sources in the main body of the image forming apparatus 1, such as magnetic fields generated around motors and a harness, or an electromagnetic wave generated from a high-voltage-generating circuit, it is preferable that the electromagnetic shield material is disposed in consideration of blocking the noises. The image forming apparatus according to the present invention includes an electromagnetic shield material which covers at least the communication device and the communication section, when the attaching part is attached to the main body of the image forming apparatus.

As described, the image forming apparatus according to the present invention includes the electromagnetic shield material which covers at least the communication device and communication section, when the attaching part is attached to the main body of the image forming apparatus.

Therefore, when information communication is performed between the attaching part and the communication unit provided in the main body of the image forming apparatus, the electromagnetic shield material blocks the external electromagnetic wave or magnetic field, thereby allowing stable transmission and reception of information between the communication device and the communication section.

Further, it is preferable that the image forming apparatus according to the present invention has the electromagnetic shield material provided in the main body of the image forming apparatus.

With the structure, the electromagnetic shield material is not provided in an attaching part that is exchanged according to necessity, but in the main body of the image forming apparatus. Therefore, the electromagnetic shield material provided in the image forming apparatus can be used repeatedly. On this account, the communication device and the communication section can be covered with the electromagnetic shield material only by attaching the attaching part to the main body of the image forming apparatus, even though the electromagnetic shield material is not provided in each attaching part.

Further, it is preferable that the image forming apparatus according to the present invention has the electromagnetic shield material provided so as to be combined with the communication section.

With the structures, the electromagnetic shield material is combined with the communication section, thereby allowing the electromagnetic shield material to securely cover the communication section. Further, the communication section is covered with the electromagnetic shield material, thereby preventing accidental information communication between the communication section and a communication device that is provided in an attaching part not attached to the main body of the image forming apparatus, such as a new attaching part for replacement, or a spent attaching part having been detached from the device.

Further, it is preferable that the image forming apparatus according to the present invention has the electromagnetic shield material that is at least one selected from a group including an electroless-metal-plated shield material, a conductive plastic shield material, an electromagnetic wave shield cloth, a nickel fiber sheet, an absorbent electromagnetic shield material, an electromagnetic shield rubber and an electromagnetic shield glass.

With the structure, the external electromagnetic wave or magnetic field can be securely blocked, thus performing secure transmission and reception of information between the communication device and the communication section. It allows stable communication between the image forming apparatus and the attaching part.

Further, it is preferable that the image forming apparatus according to the present invention has the communication device including a storage section for storing management information regarding the attaching part, and an antenna section.

With the structure, the communication device includes the storage section for storing the management information, thereby allowing the image forming apparatus to read out the management information stored in the storage section, or to write information in the storage section, by use of communication between the communication section of the communication unit and the communication device.

Further, the image forming apparatus according to the present invention may have the attaching part that is a developer-supplying holder for supplying developer.

Further, it is preferable that the image forming apparatus according to the present invention has the communication device provided on an outer surface of or inside the developer-supplying holder.

With the structures, it is possible to provide the image forming apparatus for realizing stable information communication between the communication device provided in the developer-supplying holder and the communication unit.

The image forming apparatus of the present invention is preferably used as a device which performs wireless communication with an attaching part that is detachable to the device, such as a photocopier, a printer, a facsimile, or a multi-functional device equipped with all of these functions. A notable effect of the present invention is that even when the image forming apparatus is installed in a room where miscellaneous electric appliances are placed, and thus there is a possibility that the communication between the image forming apparatus and the attaching part is interfered by an electric wave from the electric appliances, the image forming apparatus of the present invention ensures accurate information communication.

The present invention is not limited to the above embodiments, and a variety of modifications are possible within the scope of claims explained below. Namely, embodiments obtained by combining technical means modified within the scope of the claims are also within the technical scope of the present invention.

Further, concrete embodiments in "DESCRIPTION OF THE EMBODIMENTS" are explained first and foremost to clarify technical contents of the present invention. The present invention is not limited to such concrete embodiments, and a variety of modifications are possible within the scope of the spirit of the present invention and within the scope of the claims.

What is claimed is:

1. An image forming apparatus including a main body and an attaching part detachable to its main body, said attaching part including a communication device for carrying out non-contact information communication with a communication section of a communication unit included in the main body of the image forming apparatus, the image forming apparatus comprising:

an electromagnetic shield material which covers at least said communication device and said communication section, when said attaching part is attached to the main body of the image forming apparatus;

an attaching part containing section covering the entire body of the attaching part and provided for fixing the attaching part to the main body so that said communication device is disposed opposite to said communication section;

wherein said communication section is provided inside the attaching part containing section on a surface thereof;

wherein said attaching part is rotatably disposed inside the attaching part containing section;

wherein said electromagnetic shield material is provided on an outer surface or an inner surface of the attaching part containing section, or said electromagnetic shield material forms said attaching part containing section;

so that no electromagnetic shield material is provided between an antenna section of the communication section and an antenna of the communication device.

2. The image forming apparatus as set forth in claim 1, wherein said electromagnetic shield material is provided in the main body of the image forming apparatus.

3. The image forming apparatus as set forth in claim 1, wherein said electromagnetic shield material is combined with said communication section.

4. The image forming apparatus as set forth in claim 1, wherein said electromagnetic shield material is at least one material selected from a group consisting of an electroless-metal-plated shield material, a conductive plastic shield material, an electromagnetic wave shield cloth, a nickel fiber sheet, an absorbent electromagnetic shield material, an electromagnetic shield rubber and an electromagnetic shield glass.

5. The image forming apparatus as set forth in claim 1, wherein said communication device includes a storage section for storing management information regarding said attaching part, and an antenna section.

6. The image forming apparatus as set forth in claim 1, wherein said attaching part is a developer-supplying holder for supplying developer.

7. The image forming apparatus as set forth in claim 6, wherein said communication device is provided on an outer surface of or inside said developer-supplying holder.

* * * * *